US007585006B2

(12) United States Patent
Alacqua et al.

(10) Patent No.: US 7,585,006 B2
(45) Date of Patent: Sep. 8, 2009

(54) HOUSEHOLD APPLIANCE, NAMELY A MACHINE FOR WASHING AND/OR DRYING LAUNDRY, WITH A DOOR BLOCK/RELEASE DEVICE THAT CAN BE ACTUATED ELECTRICALLY

(75) Inventors: Stefano Alacqua, Cascine Vica Rivoli (IT); Francesco Butera, Turin (IT); Gianluca Capretti, Orbassano (IT)

(73) Assignee: C.R.F. Societa Consortile per Azioni, Orbassano (Turin) (IT)

( * ) Notice: Subject to any disclaimer, the term of this patent is extended or adjusted under 35 U.S.C. 154(b) by 268 days.

(21) Appl. No.: 11/155,618

(22) Filed: Jun. 20, 2005

(65) Prior Publication Data

US 2006/0012190 A1 Jan. 19, 2006

(30) Foreign Application Priority Data

Jul. 13, 2004 (EP) ..... 04425520

(51) Int. Cl.
*E05B 15/02* (2006.01)

(52) U.S. Cl. ..... 292/341.16; 292/DIG. 69; 292/341.15; 292/244; 292/DIG. 66

(58) Field of Classification Search ..... 292/341.16, 292/341.15 X, DIG. 69 X, DIG. 84, 244 X, 292/201, 144, 163, 174, 146, 150; 335/220; 70/279

See application file for complete search history.

(56) References Cited

U.S. PATENT DOCUMENTS 3,458,675 A * 7/1969 Gaudio Italo Del ..... 200/61.64
3,602,015 A * 8/1971 Hughes ..... 68/12.26
3,617,957 A * 11/1971 Brighenti ..... 337/77
4,032,180 A * 6/1977 Pohl ..... 292/341.16
4,620,735 A * 11/1986 Heydner ..... 292/144
5,174,618 A * 12/1992 Kropf ..... 292/254
5,312,152 A * 5/1994 Woebkenberg, Jr. et al. ..... 294/86.4
5,655,394 A * 8/1997 DiRocco, Jr. ..... 70/159
5,695,223 A * 12/1997 Boticki ..... 285/23
6,326,707 B1 * 12/2001 Gummin et al. ..... 310/12
6,603,377 B2 * 8/2003 Cho et al. ..... 335/186
6,732,516 B2 * 5/2004 Butera et al. ..... 60/527
6,761,381 B2 * 7/2004 Prada et al. ..... 292/121
6,762,515 B2 * 7/2004 Gummin et al. ..... 310/12
6,835,083 B1 * 12/2004 Alacqua et al. ..... 439/310
6,840,553 B2 * 1/2005 Dirnberger et al. ..... 292/341.16

(Continued)

FOREIGN PATENT DOCUMENTS

DE 19601228 A1 * 7/1997
EP 0 465 885 1/1992

(Continued)

*Primary Examiner*—Peter M. Cuomo
*Assistant Examiner*—Mark Williams
(74) *Attorney, Agent, or Firm*—Nixon & Vanderhye, P.C.

(57) ABSTRACT

A household appliance comprises a cabinet, a door and a door block/release device. In normal conditions, the device is actuated by electrically powered actuator means whilst in case of need the device can be actuated by means of a release system. The device comprises an actuation element, preferably made of shape memory material, inserted within a movable body. The device is capable of passing from the condition of blocking to that of releasing the door both by means of a movement of the actuation element caused by the electrical power supply control of the actuator means and by means of a manual actuation, using the housing body as an element of manual mechanical transmission.

21 Claims, 6 Drawing Sheets

U.S. PATENT DOCUMENTS

| | | | | |
|---|---|---|---|---|
| 6,928,812 | B2 * | 8/2005 | Donakowski et al. | 60/527 |
| 6,972,659 | B2 * | 12/2005 | von Behrens et al. | 337/139 |
| 7,073,332 | B2 * | 7/2006 | Butera et al. | 60/527 |
| 7,086,885 | B2 * | 8/2006 | Alacqua | 439/266 |
| 2002/0101313 | A1 * | 8/2002 | Dirnberger et al. | 335/220 |
| 2004/0104580 | A1 * | 6/2004 | Spiessl et al. | 292/84 |
| 2004/0118434 | A1 * | 6/2004 | Virgilio et al. | 134/18 |
| 2006/0033346 | A1 * | 2/2006 | Ala | |

FOREIGN PATENT DOCUMENTS

| | | | |
|---|---|---|---|
| EP | 0 600 390 | | 6/1994 |
| EP | 965677 | A1 * | 12/1999 |
| EP | 0 977 104 | | 2/2000 |
| EP | 1 113 103 | | 7/2001 |
| JP | 11200695 | A * | 7/1999 |
| JP | 2005209728 | A * | 8/2005 |

* cited by examiner 6
10
III
11
8
13
13
15
15
14
14
25
34a
34a
33
23
C'
32
33'
34
31
30
C'
39
S
38
35
B
SC
24
22
36
29
26
23
28
37
28a
27

HOUSEHOLD APPLIANCE, NAMELY A MACHINE FOR WASHING AND/OR DRYING LAUNDRY, WITH A DOOR BLOCK/RELEASE DEVICE THAT CAN BE ACTUATED ELECTRICALLY

BACKGROUND OF THE INVENTION

The present invention relates to a household appliance, namely a machine for washing and/or drying laundry, comprising a cabinet, a door and a door block/release device that can be actuated electrically.

Various types of household appliances have the characteristics indicated above. For example, machines for washing and/or drying laundry, be they of the front loading or top loading type, are provided with a door, through which the user has access to a drum, for the normal operations of loading and unloading the laundry. Machines of the aforementioned type are also provided with a device for locking/releasing the door; for regulatory reasons, the aforesaid device incorporates safety means, operative to prevent the door from opening during the operating cycle of the machine, and vice versa the operation of the machine with the door open.

In some types of machines, the locking/releasing device can be operated by means of a handle associated with the door. In the case of front loading laundry washing or drying machines, given the generally lowered position of the door, the actuation of the aforesaid handle forces the user to bend down in tiring fashion.

For this purposes, therefore, machines have been proposed with mechanical transmission systems, to allow to transfer control over the locking/releasing device to a more favourable position, in particular by means of a push-button positioned on the control panel of the machine. Such devices with remote mechanical actuation are oftentimes not fully satisfactory, both due to the high force of control required, and to their structural complexity.

Therefore, locking/releasing mechanisms have also been proposed whose mechanical part is actuated locally by actuator means which are electrically powered as a result of the actuation of a push-button positioned on the control panel of the machine, or as a result of a signal generated by the control system of the household appliance,.

In such electrically actuated devices, in some situation, it is necessary to unlock the door manually. Think for instance of the case of a malfunction of the actuator that actuates the mechanical part of the locking/releasing device, or of a malfunction of the control system that operates said device, or else of an interruption in the mains voltage powering the household appliance.

The document EP-A-0 977 104 discloses a bi-stable actuation system, operated through a wax electro-thermal actuator and usable in combination with a mechanical device for locking/releasing the door of a household appliance. The described system can be unlocked manually, through an appropriate mechanical arrangement, if the need arises, e.g. if main power supply fails or the control system of the household appliance malfunctions. Said arrangement comprises a slot formed in the casing of the device, accessible from the exterior of the household appliance, in which the end of an appropriate tool can be inserted to "reset" the system, towards a respective door release position. The system according to the aforementioned prior document, in addition to requiring the use of an appropriate tool, is complex from the mechanical viewpoint and hence potentially not very reliable over time.

SUMMARY OF THE INVENTION

In light of the prior art described above, the object of the present invention is to provide a household appliance equipped with a device for locking/releasing the respective door, able to be actuated both electrically and manually, which is of new conception, simple to manufacture and has minimal bulk.

This object is achieved, according to the present invention, by a household appliance having the characteristics specified in the appended claim 1. Particularly advantageous characteristics of the household appliance according to the invention are set out in the dependent claims.

BRIEF DESCRIPTION OF THE DRAWINGS

Additional objects, characteristics and advantages of the invention shall become readily apparent from the description that follows with reference to the accompanying drawings, provided purely by way of non limiting example, in which.

DETAILED DESCRIPTION OF THE INVENTION

Figure 1:
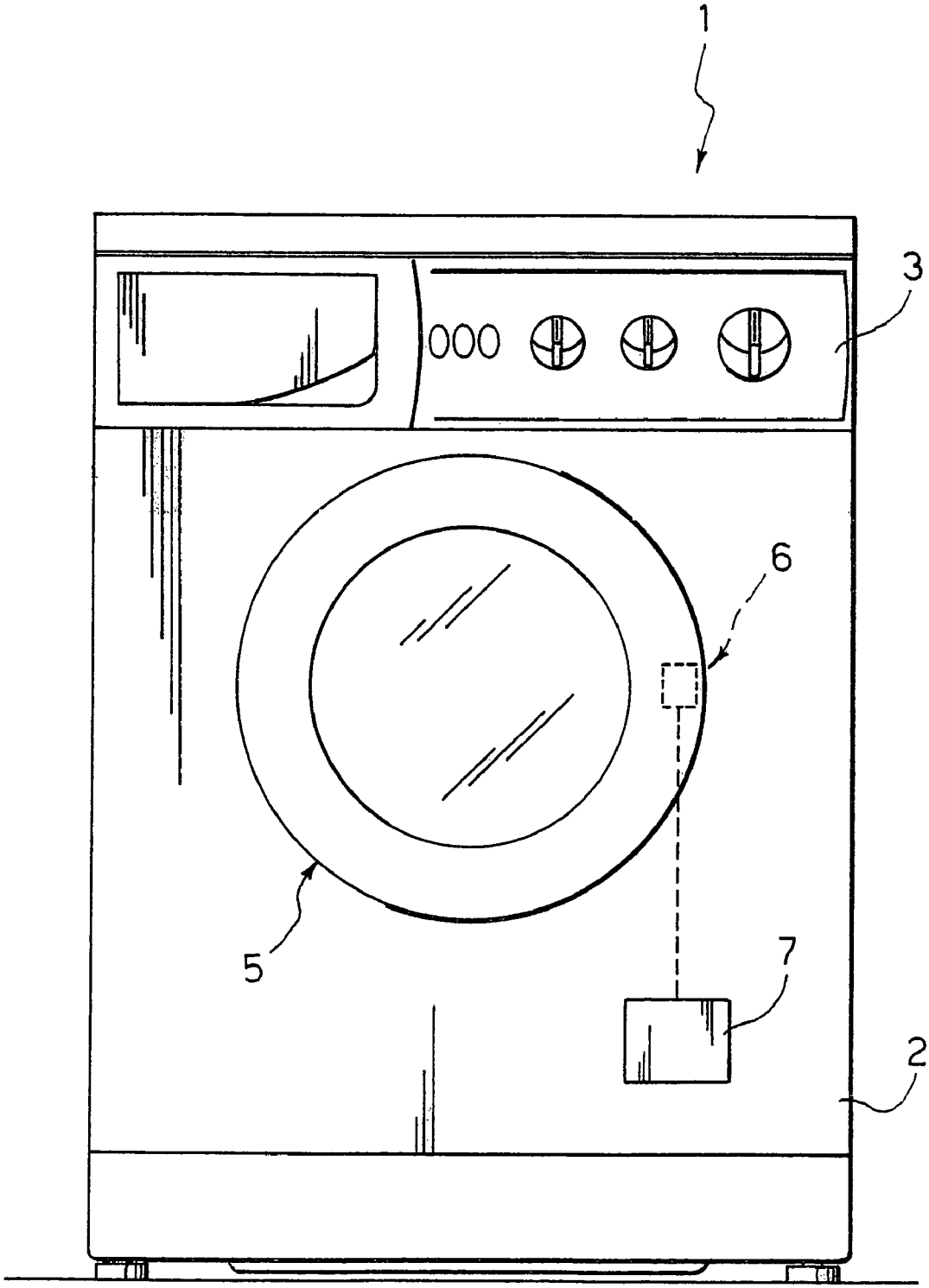
FIG. 1 is a front schematic view of a machine for washing and/or drying laundry according to the invention, with the front loading door closed.
Figure 2:
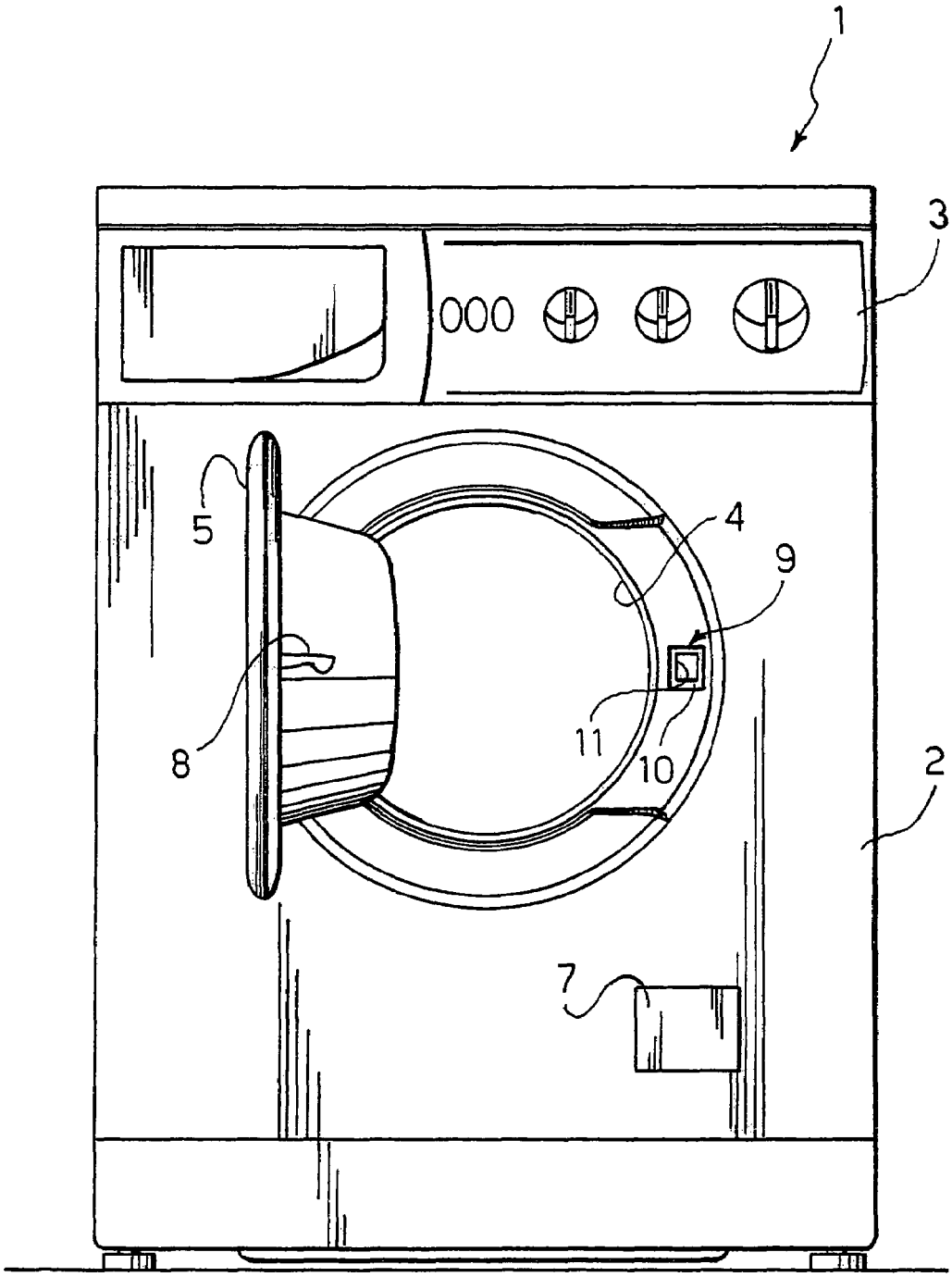
FIG. 2 is a schematic lateral view of the machine of FIG. 1, with the front loading door half opened.

FIGS. 1 and 2 show a household appliance according to the invention which, in the case exemplified herein, is a front loading laundry washing machine, globally designated by the reference 1; however, the invention can be applied to other types of household appliances, such as laundry washer-dryer machines, laundry dryer machines, dishwashers, cooking ovens, etcetera.

The machine 1 comprises a metal plate cabinet 2, in the upper part whereof is mounted a control panel 3; in the front part of the cabinet 2 is present an opening, designated by the reference 4 in FIG. 2, for access to an internal drum of the machine, for the purposes of the normal laundry loading/unloading operations. The reference number 5 globally designates the loading door of the machine 1, which is provided, for closing the aforesaid opening 4.

The machine 1 is provided with a system for locking/releasing the door 5, shown only schematically in FIG. 1, and globally designated by the reference 6; the reference 7 designates a small door present on the front wall of the cabinet 2, aimed at allowing to access internal components of the machine, such as the filter of a washing pump, for the purposes of its periodic cleaning.

In the case shown merely by way of example in FIG. 2, the block/release system 6 comprises an engagement tooth 8, associated with the door 5, and an opening 9, defined on the front wall of the cabinet 2, into which opening the tooth 8 is able to be inserted; inside the cabinet 2, substantially at the opening 9, is mounted a mechanical device for blocking/releasing the tooth 8, which in normal conditions is actuated by electrical actuating means, but in conditions of necessity can be actuated manually. For this purpose, as will become readily apparent below, the system 6 comprises a manual command part, accessible at the area to the rear of the door 7.

The aforesaid mechanical device can be of any known type, since its construction has no bearing on the aims of the present invention; the device could, for instance, be of the type comprising a plate provided with a slot, in which the tooth 8 is able to engage, the plate being able to slide as a result of the operation of the aforesaid electrical actuator means to produce the disengagement of the slot from the tooth 8; alternatively, the aforesaid mechanical device could comprise a lever able to move angularly, between a first position of engagement and a second position of disengagement with respect to the tooth 8, the passage between the first and the second position being produced by the operation of the aforesaid electrical actuator means.

In yet a different possible embodiment, the block/release device 6 could have an inverse arrangement with respect to the one exemplified, i.e. it could have an angularly moveable tooth, mounted on the cabinet 2 of the machine, and an engagement seat for said tooth, defined on the door 5, the angular movement of the tooth, in the sense of freeing itself from the engagement seat, being produced by the action of the aforesaid electrical actuator means.

Figures 3, 4, 5:
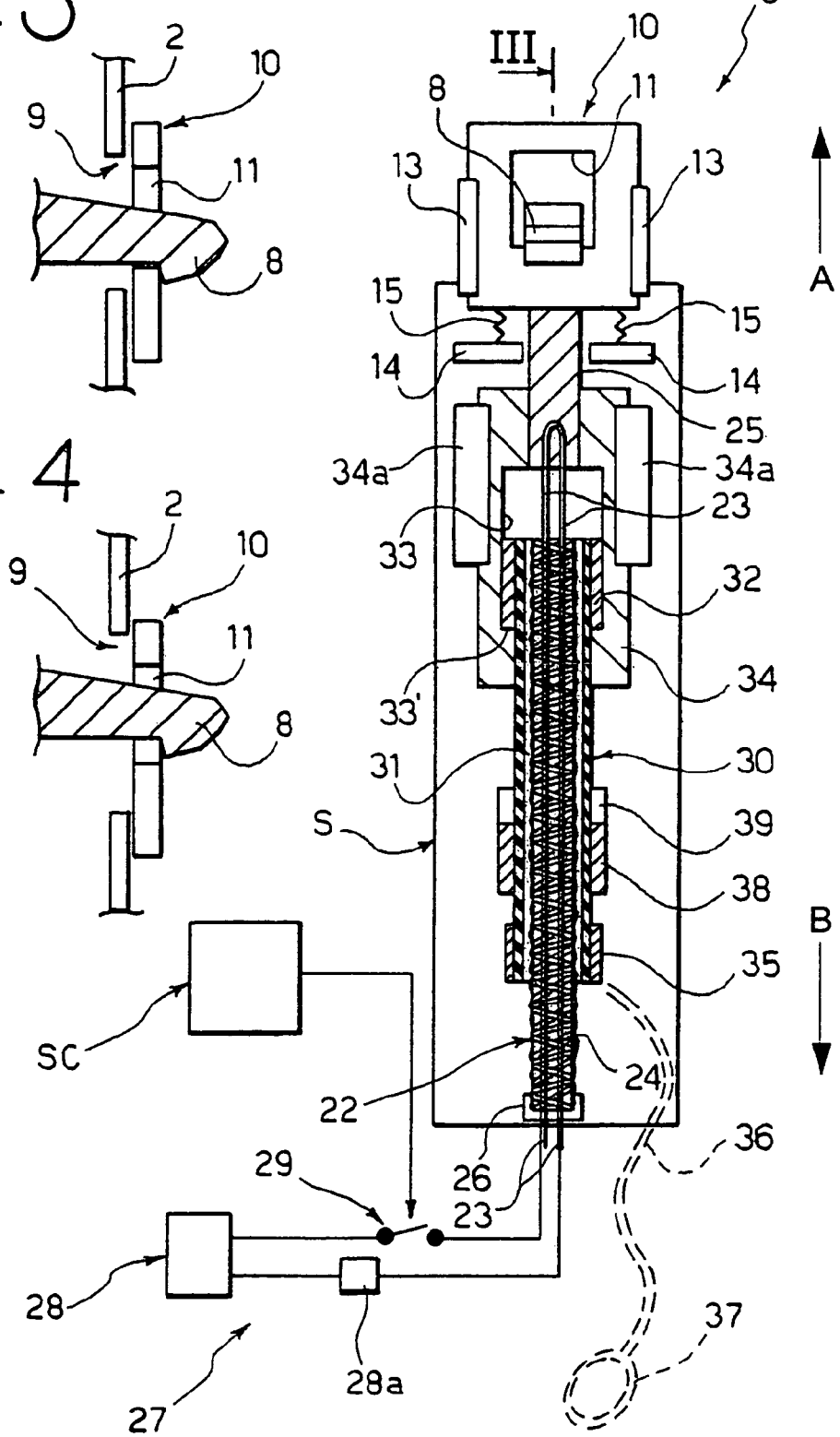
FIGS. 3 and 4 are schematic sections of two mechanical components of a door block/release device of the machine shown in FIGS. 1 and 2, in two different operative conditions.
FIG. 5 is a schematic, partially sectioned view of a system for actuating one of the components shown in FIGS. 3 and 4, FIG. 6 and 7 are schematic views similar to FIG. 5, showing the actuating system following an electrical and a manual actuation, respectively.

In the case exemplified in FIG. 2, and as shown also in FIG. 3, substantially at the opening 9 and inside the cabinet 2, is mounted a plate 10, capable of sliding vertically, provided with a slot 11 into which the tooth 8 is capable of engaging. The operating principle of the mechanical system constituted by the tooth 8 and by the plate 10 is schematically shown in FIGS. 3 and 4.

In FIG. 3, the plate 10 is in a first operative position in which, closing the door 5, the tooth 8 penetrates into the opening 9 and then enters the slot 11; the tooth 8 is so shaped that its frontal part, coming in contact with the lower edge of the slot 11, determines a slight lowering of the plate 10, with the subsequent engagement of the tooth on the aforesaid edge, and the simultaneous return of the plate 10 to the initial position, by virtue of the action of elastic return means (schematically represented in FIG. 5 by two helical springs 15); in combination or alternatively, the tooth 8 could be mounted elastically on the door 5, with the possibility of slight angular movement upwards, to "overcome" the lower edge of the slot 11.

In the condition of FIG. 3, therefore, the door 5 is locked shut.

To allow the opening of the door 5, the plate 10 must be moved downwards, so that the lower edge of its slot 11 frees the tooth 8, as shown in FIG. 4. The vertical downwards translation of the plate 10 is produced in normal conditions by electrical actuator means, comprised in the system 6 illustrated in detail in FIG. 5.

The block/release system 6 can further comprise an electrical safety device, for instance bimetallic, mounted inside the cabinet 1, which mechanically blocks the tooth 8 throughout the duration of an operating cycle of the machine, thereby preventing an accidental opening of the door 5. The same safety device is conceived to prevent the machine 1 from starting to operate if the door 5 is open. The aforesaid safety device is not shown, as it can be of any known kind, its construction being outside the scope of the objects of the present description.

In FIG. 5, the plate 10 is shown in view; the plate 10 is associated to guiding means 13, in such a way as to be able to slide only in the vertical direction; the guiding means 13 are integral with a support S of the system, fastened to the structure of the machine 2; to the support S are also associated stands 14 for respective springs 15, tending to maintain the plate 10 in the raised position, i.e. the position of FIG. 3.

In the lower part of FIG. 5 is shown the actuation system of the plate 10, which comprises an electrically powered actuator.

Said actuator comprises an element constructed, at least for a portion thereof, of a shape memory metal alloy. The shape memory actuator elements have long been known and used in various fields in which it is necessary to have simple and low cost actuator means available. They use shape memory metal alloys able to be deformed as a result of exceeding a predetermined transition temperature. In general, heating can be obtained by feeding an electrical current through the actuator element, in order to heat it by Joule effect. In this case, the electrical power supply means can be associated with electronic control means able to control the current supply as needed.

In the embodiment shown herein, the aforesaid actuator made of shape memory allow is configured as a flexible cable 22, formed by a wire made at least in part of a shape memory alloy, designated by the reference number 23, embedded within a respective coating 24. The wire 23 has a U configuration inside the coating 24, with a first run and a return run and its two ends mutually adjacent; this allows an easy electrical connection of the wire 23 to electrical power supply means.

In the example the upper end of the cable 22, constituted by the actual U-shaped portion of the wire 23 which projects from the coating 24, is secured to an element 25 made integral with the plate 10. At the lower end of the cable 22, from the coating 24 project the two ends of the wire 23; the lower end of the cable 22, or otherwise the two projecting ends of the wire 23 are mechanically anchored to the support S, by fastening means 26, known in themselves; said ends of the wire 23 are connected to a power supply circuit 27, comprising a source of electrical power supply 28 and a switch 29. In a preferred embodiment, the power supply circuit 27 comprises, protection means **28*a* of the element made of shape memory material, constituted for example by a PTC element (i.e., a resistor with positive temperature coefficient), connected in series between the source 28 and the wire 23. When a PTC element is powered electrically, in voltage or in current, it initially has a relatively low ohmic resistance value for a short time, and subsequently passes to a condition distinguished by a high value of ohmic resistance. This property allows to use the PTC element 28*a* as a sort of switch, to obtain a rapid power supply and hence a rapid actuation of the wire 23, in the initial low-resistance phase; once a certain period of time, predetermined during the design stage, expires, the PTC element 28*a* passes to the final phase of high resistance, in fact automatically interrupting the electrical power supply to the wire 23**.

The cable 22 extends inside a flexible sheath 30, with the possibility for relative sliding, the sheath 30 being able to be obtained from any known material typically adopted for said purpose. Between the cable 22 and the sheath 30 can be provided a spacer layer 31.

At the upper end of the sheath 30 is anchored a first bushing 32, able to slide within an inner cavity 33 of a body 34, in turn able to slide within respective guiding means **34*a*, and with which the element 25 is integral. The bushing 32 abuts against an end surface 33' of the aforesaid cavity 33 of the body 34**.

To the lower end of the sheath 30 is anchored a second bushing 35, whereto is connected a cable 36 fastened to a ring 37, shown in dashed lines in FIG. 5; the cable 36 has such length that the ring 37 is positioned substantially at a compartment behind the small door 7 present on the front wall of the cabinet 2 of the machine 1; as can be intuited, the cable 36 allows to transfer to the sheath 30 a manual traction exerted by means of the ring 37.

On the sheath 30 is further secured an intermediate bushing 38, designed to abut against a fixed stop 39 fastened to the support S. The co-operating action of the bushing 38 integral with the sheath 30 and of the stop 39 prevents a displacement of the sheath in the direction indicated by the arrow A.

The operation of the system 6 illustrated in FIG. 5 is as follows.

In conditions of normal operation of the machine 1, the displacement of the plate 10 between the position of FIG. 3 to that of FIG. 4 is obtained by means of the electrical actuator constituted by the cable 22.

For this purpose, the cable 22 is powered through the circuit 27 which, as a result of the closure of the switch 29, applies a difference in potential between the two ends of the wire 23 made of active shape memory material. The shutting of the switch 29 is preferably automatically commanded by the control system of the machine, designated by the reference SC, at the end of a wash cycle; alternatively, the operation of the switch 29 could be produced, in known fashion, as a result of the pressing of a push-button, located on the control panel 3, which can be operated by the user of the machine 1.

Figure 6:
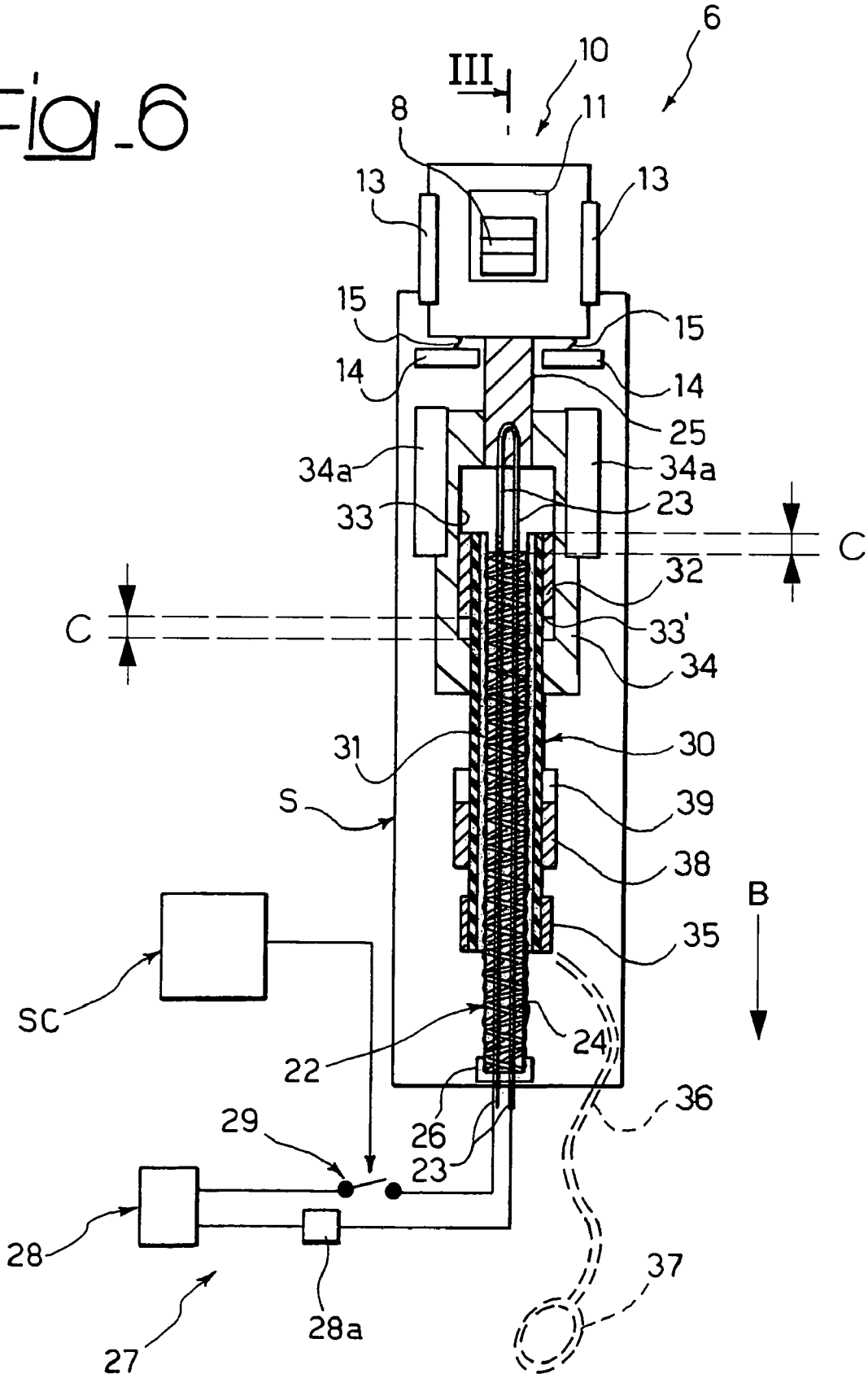

As a result of being powered, the wire 23 of the cable 22 heats up by Joule effect; upon exceeding a transition temperature, typical of the shape memory material or alloy in use, the wire 23 shortens, also determining a compression of the respective coating 24, and hence, essentially, a shortening of the cable 22 as a whole, as indicated by C in FIG. 6.

Given that the ends of the cable 22 and/or the ends of the wire 23 are secured in a fixed position, through the means 26, their shortening causes a corresponding downward sliding C of the body 34 over the sheath 30, with the abutting surface 33' of the respective cavity 33 which distances itself from the bushing 32 integral with the sheath 30. Said sheath 30 remains motionless, not being able to move upwards as a result of the engagement of the intermediate bushing 38 against the fixed stop 39. The downwards motion of the body 34 and of the element 25 associated therewith thereby determines a displacement of the plate 10 in the direction of actuation indicated by the arrow B, with its passage from the position of FIG. 3 to the position of FIG. 4. The device 6 is then in the respective position of release, and the door 5 can be opened.

In a possible embodiment, between the cabinet 2 of the machine 1 and the door 5 can be provided an elastic system, for example with springs, able to produce an automatic opening motion of the door itself, after the tooth 8 is released by the plate 10. In this case, some instants after the actuation, and the consequent automatic opening of the door, the control system SC reopens the circuit 27, interrupting power supply to the cable 22.

Alternatively, the opening of the door 5, and hence the exit of the tooth 8 from the slot 11 of the plate 10 can be detected by known sensor means (e.g., a micro-switch); the signal produced by said sensor means is used by the control system SC to command the opening of the switch 29.

If, for any reason (e.g., a malfunction of the control system SC, a mains black-out, etcetera) the electrical actuator is not capable of being operated in the normal manner described above, the user of the machine can actuate the system 6 manually, opening the small door 7 and acting on the ring 37.

Figure 7:
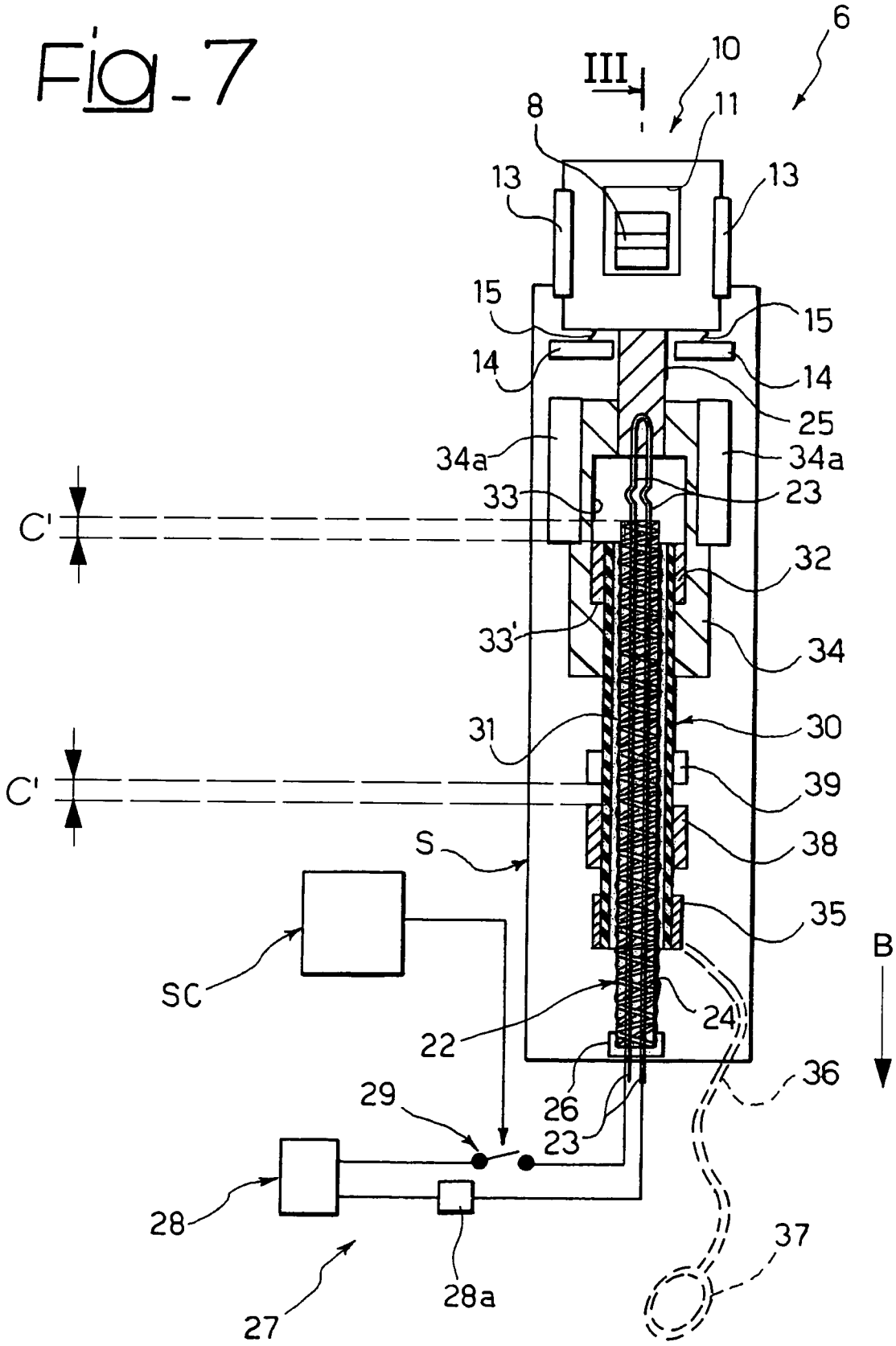
Figure 8:
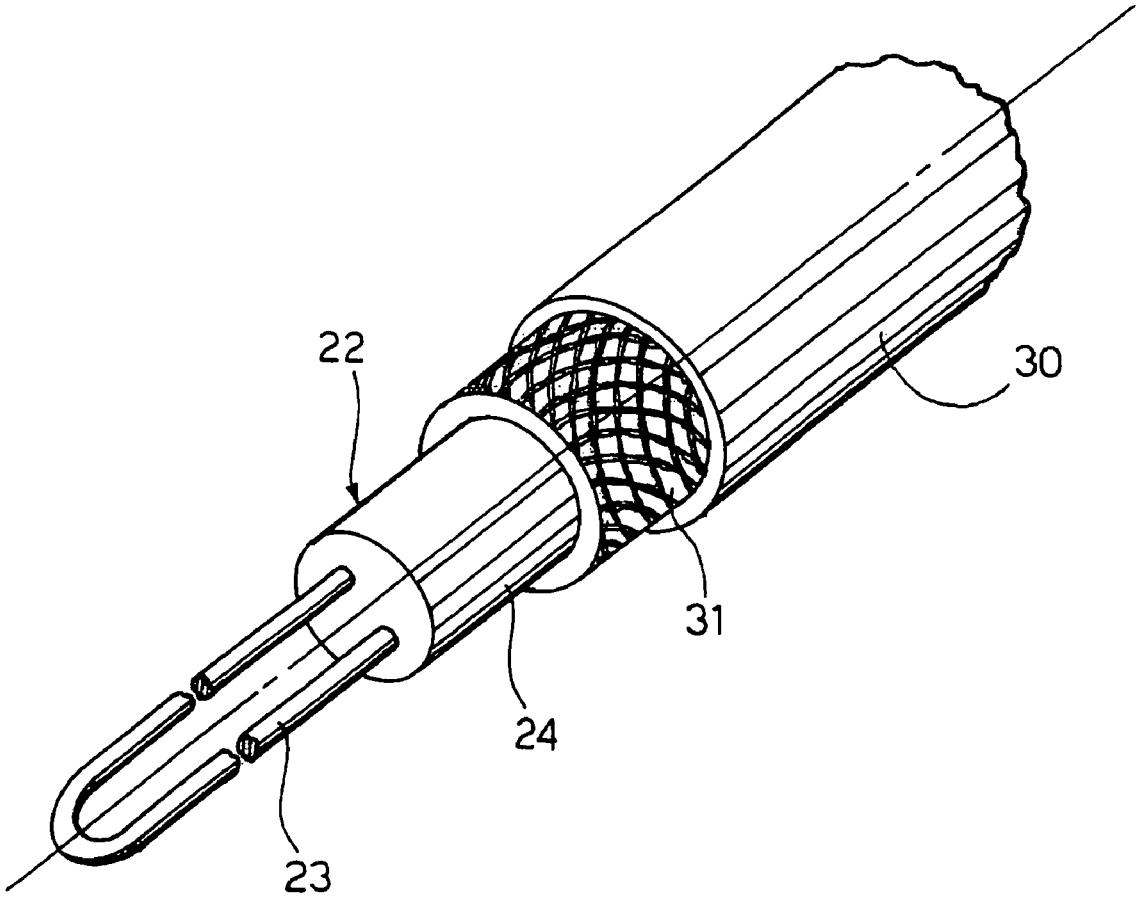
FIG 8 is an exploded perspective view of a detail of an actuator device used in the system of FIG. 5.

The mechanical traction imparted manually on the ring 37, and hence on the cable 36, is transmitted to the sheath 30, which then moves downwards in the direction of actuation B, causing the intermediate bushing 38 to move away from the fixed stop 39, as indicated by C' in FIG. 7. The displacement of the sheath 30 causes a corresponding downwards displacement C' of the body 34, since to the upper end of the sheath 30 is anchored the bushing 32, which abuts against the end surface 33' of the cavity 33 of the body 34. The displacement thereof consequently causes a similar displacement of the element 25, and hence of the commanded member constituted by the plate 10, which reaches the position of FIG. 4. The maximum limit of downwards displacement of the body 5 can be determined by the stands 14, or by additional stops integral with the support S, not shown.

The support S, and hence all the components of the block/release system 6 shown in FIG. 5, is mounted internally to the cabinet 2; the tooth 8 is, as stated, associated with the door 5 and the ring 37 is accessible through the small door 7.

In the preferred embodiment of the invention, the actuation device constituted by the cable 22 and by the sheath 26 has a structure of the type shown in FIG. 6. As shown, the flexible cable, with the flexible sheath 30, and the spacer layer 31, which in the illustrated case is constituted by a metal braiding, are provided.

The flexible cable 22 capable of sliding within the sheath 30 comprises the shape memory wire 23, U-shaped, over which is moulded the coating layer 24, which adheres to the wire itself; the coating layer 24 is made of an elastomeric/silicone or synthetic material, such as to favour both the cooling of the wire 23 after the cessation of the passage of electrical current, and the return of the wire 23, and hence of the entire cable 22, in its extended resting configuration, by effect of the elastic return of the coating.

The coating 24, which is adherent to the wire 23, therefore serves the function of a longitudinally distributed spring, which is subjected to compression when the wire 23 shortens as a result of its actuation, and consequently favours the return of the cable to the resting position through its elastic return.

Naturally, without altering the principle of the invention, the construction details and the embodiments may vary widely from what is described and illustrated purely by way of example herein, without thereby departing from the scope of the present invention.

For example, one can mention the possibility of using, for the purpose of embodying the invention, a cable 22 comprising a plurality of shape memory wires 23 within a same moulded coating 24.

The ring 37 could naturally be made accessible in any other area of the cabinet of the household appliance deemed convenient, e.g. in its rear part.

Instead of the ring 37, the traction on the sheath 30 aimed at determining the manual release of the system 6 could be obtained through any other known mechanical system, for instance based on a lever, a mechanical push-button, a rotary knob, a sliding cursor etcetera.

What is claimed is:

1. A household appliance comprising:

a cabinet, a door, and a door block/release device comprising:

a commanded member, an actuator means, a release system, a sheath body, an actuation element, and a fixed stop, wherein the door block/release device is capable of assuming a first condition, in which the door is blocked, and a second condition, in which the door is released, wherein passage from the first to the second condition is produced by a displacement of the commanded member in a direction of actuation, the device comprising the release system which can be operated manually to obtain the passage from the first to the second condition in such a way that the displacement of the commanded member in the direction of actuation can be achieved both by controlling an electrical power supply of the actuator means, and by means of a manual actuation of the release system, the device comprising the sheath body for the actuation element, the actuation element being connected to the commanded member and capable of moving as a result of the aforesaid electrical power supply control, wherein the release system comprises the aforesaid sheath body, which is mounted movable with respect to the fixed stop in such a way that, when the door block/release device is in said first condition, said sheath body is able to move longitudinally in the direction of actuation of the commanded member;

the sheath body is connected to the commanded member in such a way as to be able to transmit thereto a displacement in the aforesaid direction of actuation and to be unable to transmit to the commanded member a movement in a direction opposite to the direction of actuation, such that the block/release device is capable of shifting from the first to the second condition both by means of a movement of the actuation element caused by said electrical power supply control of the actuator means, and by means of manual actuation, using the sheath body as a mechanical transmission element.

2. The household appliance as claimed in claim 1, wherein the actuator means comprise the actuation element, which is at least partly made of a shape memory active material, capable of undergoing a shape change as a result of being heated.

3. The household appliance as claimed in claim 2, wherein the shape memory actuator element constitutes or is a part of a cable at least partly inserted in a sheath which constitutes the sheath body.

4. The household appliance as claimed in claim 3, wherein the sheath has a first end connected to a respective end body able to slide relative to a movable component connected to the commanded member, where the end body is kept in contact with an abutment surface of the movable component when a traction is imparted to the sheath by means of a manual actuation device comprised in the release system.

5. The household appliance as claimed in claim 4, wherein the manual actuation device is accessible from a substantially remote position relative to the door.

6. The household appliance as claimed in claim 3, wherein an intermediate stop element is associated to the sheath, capable of co-operating with the aforesaid fixed stop.

7. The household appliance as claimed in claim 3, wherein the cable has a first end, which projects out of a first end of the sheath and is connected to the commanded member, and a second end, secured in fixed position relative to the sheath.

8. The household appliance as claimed in claim 3, wherein the cable comprises a coating made of elastomer/silicone or synthetic material moulded at least in part on the active shape memory material, which coating is elastically deformed when the actuation element is actuated, in such a way as to favour the return of the cable to a respective resting position both thanks to its elastic return, and because it accelerates the cooling of the actuation element after an actuation.

9. The household appliance as claimed in claim 2, further comprising electrical power supply means to cause an electrical current to flow through the actuation element in order to heat it by Joule effect above a transition temperature of the active material, the electrical power supply means comprising a switch commanded manually or automatically by a control system of the household appliance.

10. The household appliance as claimed in claim 9, wherein the electrical power supply means comprise a PTC element connected in series between a power supply source and the actuation element.

11. The household appliance as claimed in claim 1, wherein the block/release device comprises a first engagement element associated to one of said cabinet and door, and a second engagement element, associated to the other one of said cabinet and door, where the first arid the second engagement element are capable of assuming a condition of mutual engagement and a condition of release and one of said first and second engagement element constitutes or is connected to the commanded member.

12. A household appliance comprising:

a cabinet, a door, and a door block/release device comprising:

a commanded member, an actuator means, a release system, a sheath body, an actuation element, and a fixed stop, wherein the door block/release device is capable of assuming a first condition, in which the door is blocked, and a second condition, in which the door is released, wherein passage from the first to the second condition is produced by a displacement of the commanded member in a direction of actuation, the device comprising the release system which can be operated manually to obtain the passage from the first to the second condition, in such a way that the displacement of the commanded member in the direction of actuation can be achieved both by controlling electrical power supply of the actuator means, and by means of a manual actuation of the release system, the device comprising the sheath body for the actuation element, the actuation element being connected to the commanded member and capable of moving as a result of the aforesaid electrical power supply control, wherein the release system comprises the aforesaid sheath body, which is mounted movable with respect to the fixed stop in such a way that, when the door block/release device is in said first condition, said sheath body is able to move longitudinally in the direction of actuation of the commanded member;

the sheath body is connected to the commanded member in such a way as to be able to transmit thereto a displacement in the aforesaid direction of actuation, such that the block/release device is capable of shifting from the first to the second condition both by means of a movement of the actuation element caused by said electrical power supply control of the actuator means, and by means of manual actuation, using the sheath body as a mechanical transmission element, and wherein the actuator means comprise the actuation element, which is at least partly made of a shape memory active material, capable of undergoing a shape change as a result of being heated.

13. The household appliance as claimed in claim 12, wherein the shape memory actuation element constitutes or is a part of a cable at least partly inserted in a sheath which constitutes the sheath body.

14. The household appliance as claimed in claim 13, wherein the sheath has a first end connected to a respective end body able to slide relative to a movable component connected to the commanded member, where the end body is kept in contact with an abutment surface of the movable component when a traction is imparted to the sheet by means of a manual actuation device comprised in the release system.

15. The household appliance as claimed in claim 14, wherein the manual actuation device is accessible from a substantially remote position relative to the door.

16. The household appliance as claimed in claim 13, wherein an intermediate stop element is associated to the sheath, capable of co-operating with the aforesaid fixed stop.

17. The household appliance as claimed in claim 13, wherein the cable has a first end, which projects out of a first end of the sheath and is connected to the commanded member, and a second end, secured in fixed position relative to the sheath.

18. The household appliance as claimed in claim 13, wherein the cable comprises a coating made of elastomer/silicone or synthetic material moulded at least in part on the active shape memory material, which coating is elastically deformed when the actuation element is actuated, in such a way as to favour the return of the cable to a respective resting position both thanks to its elastic return, and because it accelerates the cooling of the actuation element after an actuation.

19. The household appliance as claimed in claim 12, further comprising electrical power supply means to cause an electrical current to flow through the actuation element in order to heat it by Joule effect above a transition temperature of the active material, the electrical power supply means comprising a switch commanded manually or automatically by a control system of the household appliance.

20. The household appliance as claimed in claim 19, wherein the electrical power supply means comprise a PTC element connected in series between a power supply source and the actuation element.

21. The household appliance as claimed in claim 12, wherein the block/release device comprises a first engagement element associated to one of said cabinet and door, and a second engagement element, associated to the other one of said cabinet and door, where the first and the second engagement element are capable of assuming a condition of mutual engagement and a condition of release and one of said first and second engagement element constitutes or is connected to the commanded member.

* * * * *